US006830469B1

(12) United States Patent
Doyle et al.

(10) Patent No.: US 6,830,469 B1
(45) Date of Patent: Dec. 14, 2004

(54) ELECTRICAL CONNECTOR ASSEMBLY

(75) Inventors: Seamus Doyle, Wexford (IE); Colm Conlon, Co. Clare (IE); Francis Duggan, Clare (IE); Eugene Folan, Galway (IE); John Rochford, Clare (IE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/804,705

(22) Filed: Mar. 19, 2004

(51) Int. Cl.[7] ..... H01R 13/64

(52) U.S. Cl. ..... 439/247; 439/289; 439/378; 439/350

(58) Field of Search ..... 439/246, 247, 439/248, 289, 378, 350

(56) References Cited

U.S. PATENT DOCUMENTS

| | | | | | |
|---|---|---|---|---|---|
| 3,693,133 | A | * | 9/1972 | Harbonn et al. | 439/278 |
| 4,775,332 | A | * | 10/1988 | Bowden et al. | 439/650 |
| 4,881,901 | A | | 11/1989 | Mendenhall et al. | 439/65 |
| 5,055,054 | A | | 10/1991 | Doutrich | 439/66 |
| 5,205,739 | A | | 4/1993 | Malo et al. | 439/66 |
| 5,234,353 | A | | 8/1993 | Scholz et al. | 439/289 |
| 5,326,290 | A | | 7/1994 | Chailleux et al. | 439/862 |
| 5,516,303 | A | | 5/1996 | Yohn et al. | 439/248 |
| 5,752,845 | A | | 5/1998 | Fu | 439/247 |
| 5,934,917 | A | * | 8/1999 | Haut | 439/131 |
| 6,062,872 | A | | 5/2000 | Strange et al. | 439/67 |
| 6,083,029 | A | | 7/2000 | Wu et al. | 439/347 |
| 6,179,626 | B1 | | 1/2001 | Wu | 439/74 |
| 6,224,412 | B1 | | 5/2001 | Villain | 439/289 |
| 6,238,219 | B1 | | 5/2001 | Wu | 439/74 |
| 6,435,903 | B1 | * | 8/2002 | Nelson | 439/528 |
| 6,659,787 | B2 | * | 12/2003 | Hayashi | 439/248 |

* cited by examiner

*Primary Examiner*—Tho D. Ta
(74) *Attorney, Agent, or Firm*—Stephen Z. Weiss

(57) ABSTRACT

An electrical connector assembly is provided for mating with a complementary second connector. The assembly includes a housing mounting a terminal module for movement relative to the housing between a projecting position and a retracted position. The terminal module includes a dielectrical module body having a front mating end which projects from the housing and a rear mounting end which mounts the terminal module in the housing for movement between said positions. A plurality of conductive terminals are mounted on the module body and include front flexible contact ends projecting from the front mating end of the module body for engaging appropriate terminal contacts of the complementary second connector. When the second connector is mated with the connector assembly, the contacts of the second connector engage the front flexible contact ends of the terminals and move the terminal module from its projecting position to its retracted position.

18 Claims, 3 Drawing Sheets

ELECTRICAL CONNECTOR ASSEMBLY

FIELD OF THE INVENTION

This invention generally relates to the art of electrical connectors and, particularly, to an electrical connector assembly which includes a movable terminal module.

BACKGROUND OF THE INVENTION

A typical electrical connector includes some form of insulative or dielectric housing which mounts a plurality of conductive terminals. The housing may be molded of plastic material, for instance, and the terminals are fabricated of metal material such as stamped and formed sheet metal material. The electrical connector is mated with another complementary mating connecting device, such as a second connector. When mated, the terminals of the two connectors interengage to establish and complete a circuit through the two mated connectors.

Most mating connectors having interengaging terminals whereby the terminals of one connector slide along the terminals of the second mating connector to establish an interengagement therebetween. For instance, one connector may have male or pin terminals which are inserted into female or socket terminals to establish a conductive interengagement therebetween. The female terminals may be simple bifurcated terminals rather than having a full terminal-receiving socket. In any event, all of these types of connectors and terminals have sliding interengagement between the terminals of the two mating connectors.

On the other hand, there are mating electrical connectors which have terminals that interengage in an abutting manner. In other words, such an arrangement is like a person forming his or her hands into fists and abutting the fists together at the knuckles, with the knuckles simulating the abutting terminals of two mating electrical connectors. In other words, the terminals do not slide into mating interengagement. With electrical connectors which have abutting terminals, the terminals of one or both connectors are yieldable and/or flexible to provide a positive engagement between the terminals of the two mating connectors. For instance, terminals may be stamped out of flat sheet metal material in a sinusoidal configuration whereby the terminal, itself, acts as a spring and can compress or move linearly upon mating. In flat pad mating systems a long linear movement of the terminals is needed to enable the latches to engage the mating connector. The sinusoidal configuration used to accommodate the long movement of the terminals makes it difficult to control the normal force between the mating terminals. In addition, considerable material is wasted in fabricating the terminals. Other attempts to provide linear movement of the terminals during mating requires the formation of the terminals as coiled springs, with the distal end of the spring acting as the contact portion of the terminal. All of these types of terminals are expensive to manufacture, use a significant amount of raw material and are not applicable for high speed applications because of the long curved signal path. Still other attempts to provide linear movement of the terminals during mating fix the terminals to a movable plate of the connector. Unfortunately, with these attempts, the terminal are fairly rigid and do not provide a good positive interengagement with the terminals of the mating connector. This invention is directed to solving this myriad of problems.

SUMMARY OF THE INVENTION

An object, therefore, of the invention is to provide a new and improved electrical connector assembly of the character described.

In the exemplary embodiment of the invention, the connector assembly is designed for mating with a complementary second connector in a mating direction. A terminal module is mounted on a housing for movement relative to the housing between a projecting position and a retracted position. The terminal module includes a dielectrical module body having a front mating end which projects from the housing and a rear mounting end which mounts the module in the housing for movement between said positions. A plurality of conductive terminals are mounted on the module body and include front flexible contact ends projecting from the front mating end of the body for engaging appropriate terminal contacts of the complementary second connector. The terminals have rear terminating ends secured to the module body.

With the above structure, when the second connector is mated with the connector assembly, the contacts of the second connector engage the front flexible contact ends of the terminals and move the terminal module from its projecting position to its retracted position. In addition, the front contact ends flex to provide a good and positive contact engagement with the terminals of the second mating connector.

According to one aspect of the invention, each conductive terminal includes a base fixed in the dielectric module body. The front flexible contact end of the terminal is forwardly of the base and is joined to the base by a flexible spring arm cantilevered forwardly of the base. The front flexible contact end of each terminal has a convex configuration and presents a rounded contact surface for abutting engagement with the contacts of the second connector. The terminating end of each terminal comprises a termination arm projecting rearwardly of the base and having a conductor termination portion at the distal end thereof.

According to another aspect of the invention, biasing means are provided for biasing the dielectric module body toward its projecting position. As disclosed herein, the biasing means is provided by a coil spring sandwiched between the module body and a portion of the housing. In the preferred embodiment, the module body is elongated in a direction generally transverse to the mating direction to define opposite ends thereof. A pair of the biasing springs are sandwiched between the opposite ends of the body and portions of the housing. The housing includes a pair of interior compartments near the opposite ends of the module body within which the biasing springs are located.

According to a further aspect of the invention, the dielectric module body includes a plurality of open grooves within which the terminals are disposed. Specifically, the flexible spring arms are cantilevered forwardly within the grooves for free flexing movement therewithin, and the rounded or convexed contact ends of the terminals project out of front ends of the grooves at the front mating end of the module body.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
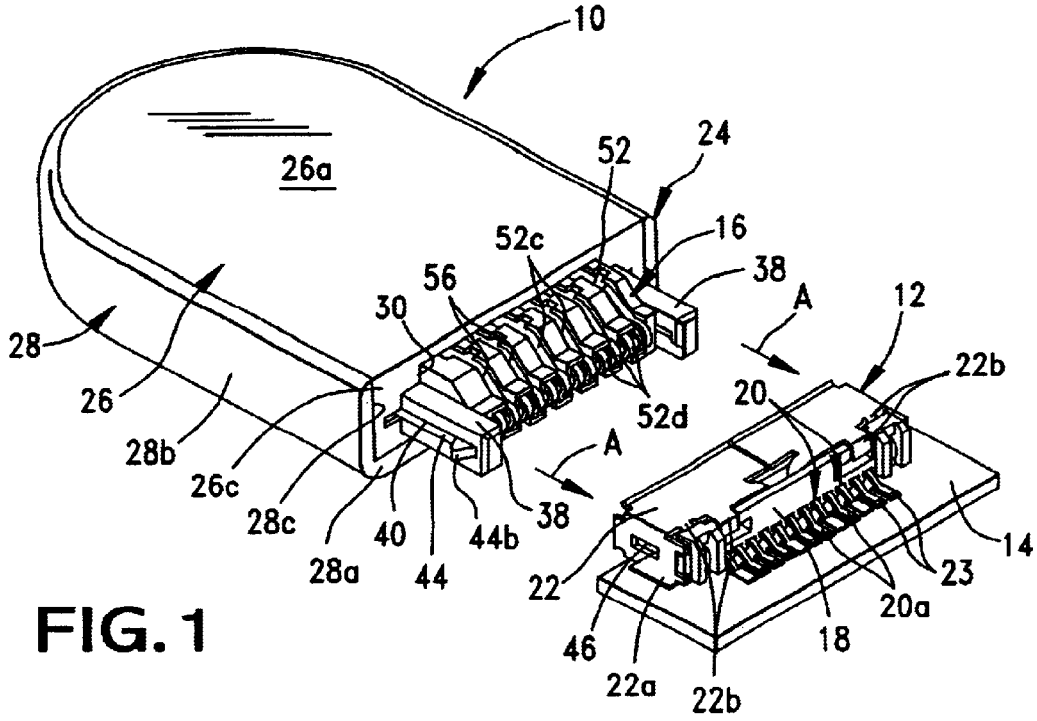
FIG. 1 is a perspective view of an electrical connector assembly incorporating the concepts of the invention in conjunction with a complementary mating second connector, with the connectors in unmated condition.
Figure 2:
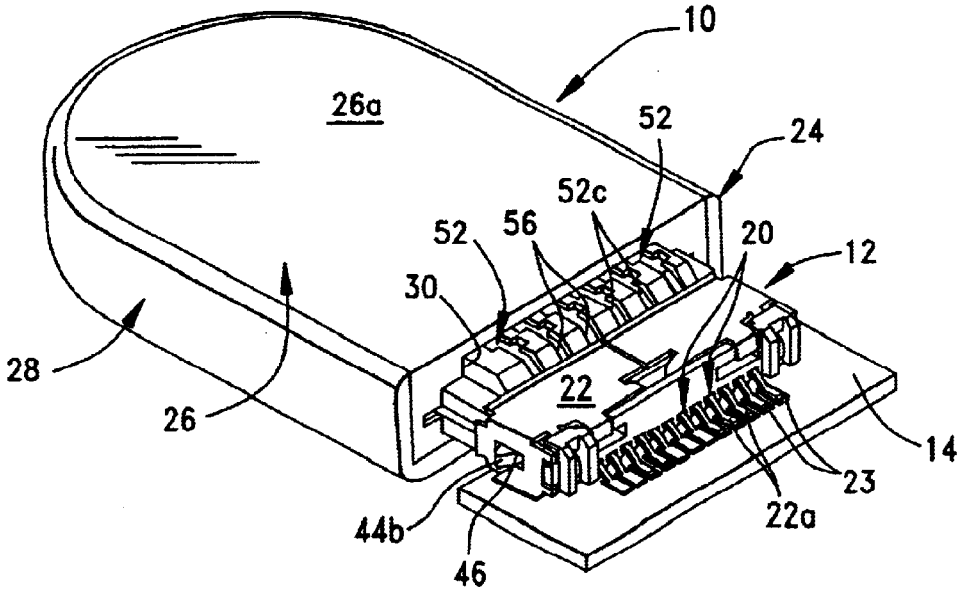
FIG. 2 is a view similar to that of FIG. 1, with the connectors in mated condition.

Referring to the drawings in greater detail, and first to FIGS. 1 and 2, the invention is embodied in an electrical connector assembly or first connector, generally designated 10, which is mateable with a complementary second connector, generally designated 12, in a mating direction indicated by arrows "A" (FIG. 1). First connector 10 embodies the concepts of the invention, and second connector 12 may take a variety of configurations for mating with connector 10. For instance, second connector 12 is shown mounted on a printed circuit board 14, but that is just one example of a complementary connecting device which is mateable with connector 10. Briefly, the invention is centered around first connector 10 having a terminal module, generally designated 16, which is movable between an extended or projecting position shown in FIG. 1 when the connector is in an unmated condition, and a retracted position shown in FIG. 2 when the two connectors are mated wherein flexible contact ends 52*d* flex to provide additional normal forces to ensure a good electrical connection.

Before proceeding with a detailed description of the connector assembly or first connector 10 which embodies the concepts of the invention, the second or mating connector 12 includes a dielectric housing 18 which mounts a plurality of conductive terminals, generally designated 20. A metal shell or shield 22 substantially surrounds the mating interface of connector 12. Terminals 20 have solder tails 20*a* for connection, as by soldering, to appropriate signal circuit traces 23 on printed circuit board 14. Metal shell 22 typically is provided for shielding purposes and will include one or more feet 22*a* for connection, as by soldering, to appropriate ground circuit traces on the circuit board. The metal shell is secured at various positions, as at 22*b*, to the dielectric housing 18. With circuit board 14 typically being fixed, first connector 10 would be mated with second connector 12 by moving the first connector in the direction of arrows "A" (FIG. 1) into mating condition as shown in FIG. 2.

Figure 3:
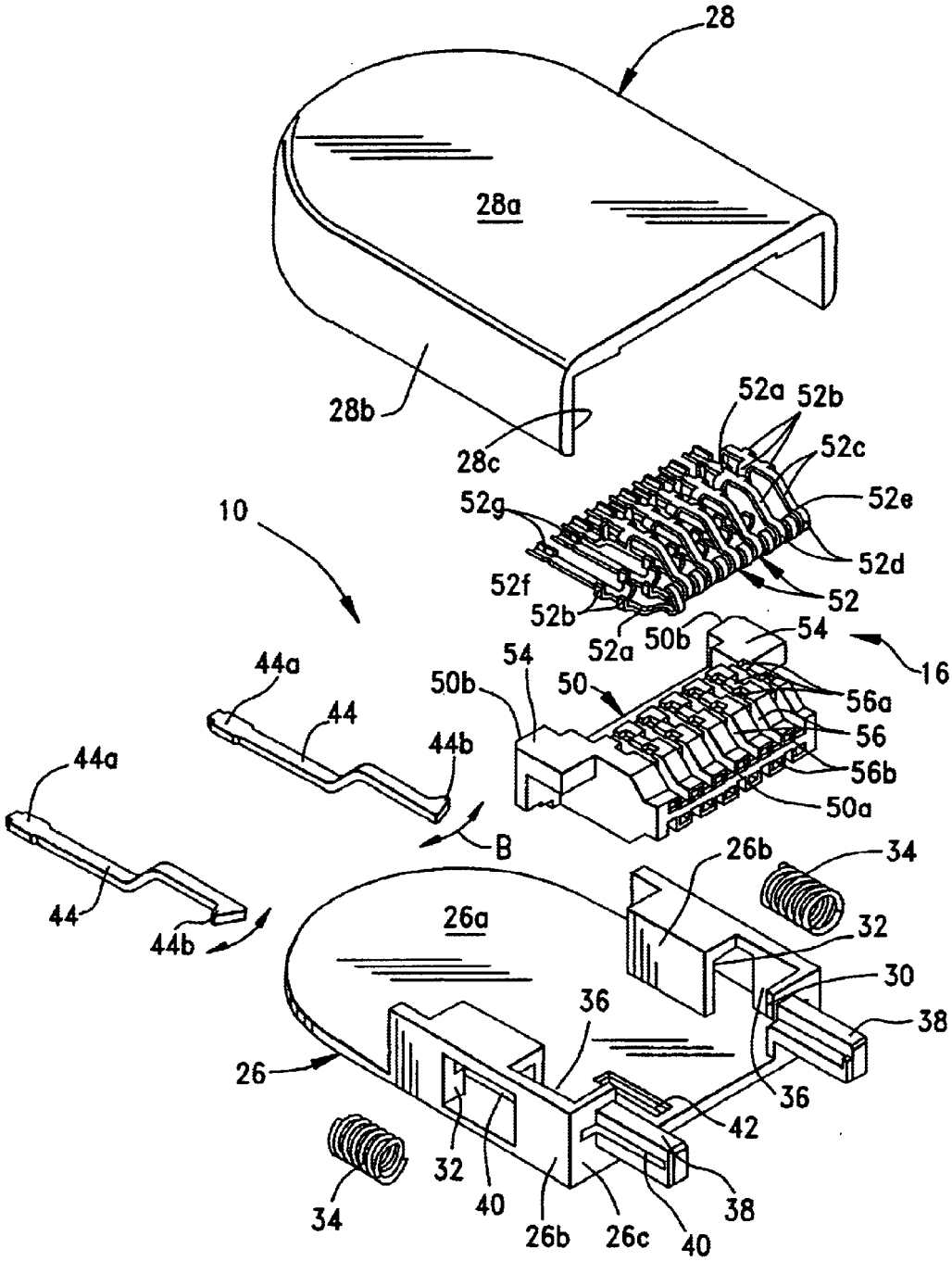
FIG. 3 is an exploded perspective view of the connector assembly of the invention.
Figure 4:
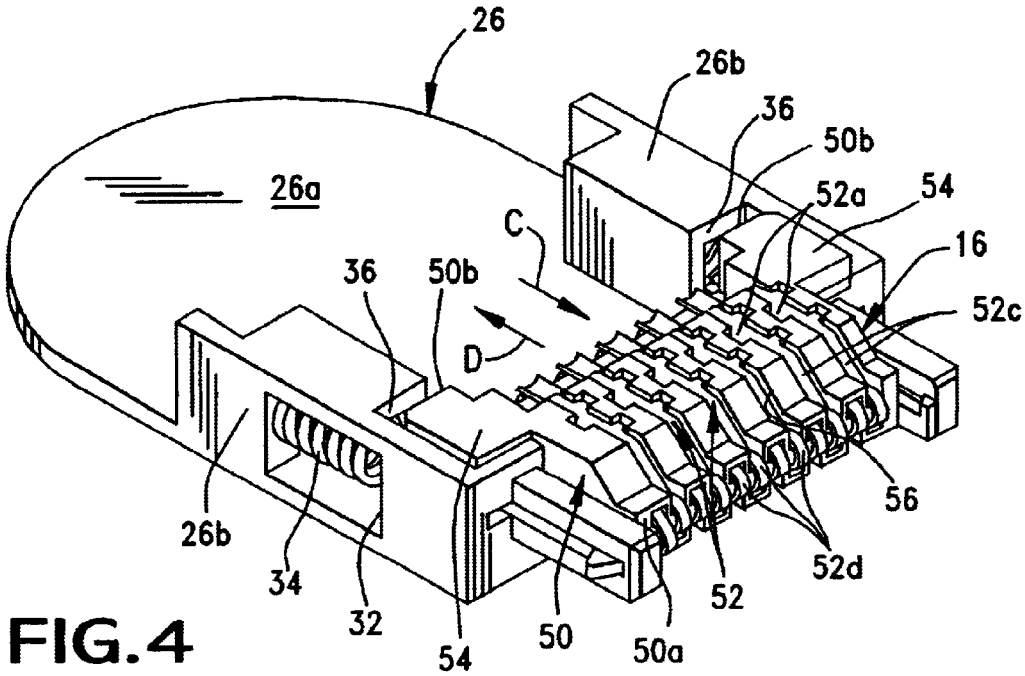
FIG. 4 is a perspective view of one of the housing parts, with the terminal module in its projecting position.
Figure 5:
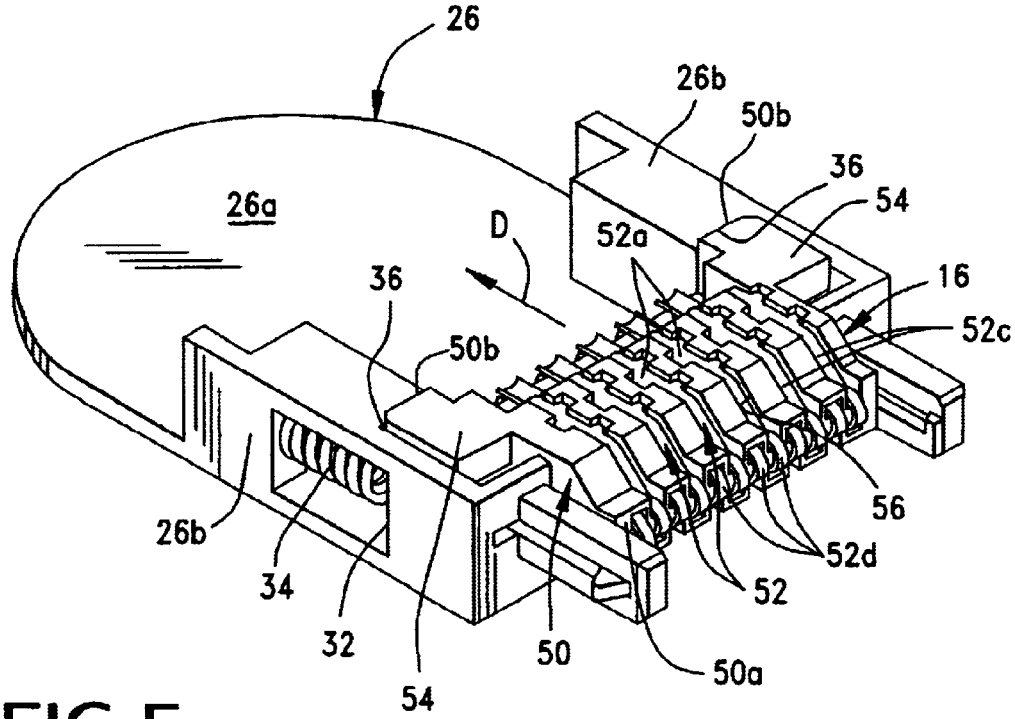
FIG. 5 is a view similar to that of FIG. 4, with the terminal module in its retracted position.

Referring to FIG. 3 in conjunction with FIGS. 1 and 2, the connector assembly or first connector 10 includes an insulative or dielectric housing, generally designated 24 in FIGS. 1 and 2. The housing is a two-part structure which includes an upper housing part, generally designated 26, and a lower housing part, generally designated 28. Each housing part is a one-piece structure molded of plastic material. At this point, it should be understood that the depictions in FIGS. 3–5 are shown inverted or upside-down from the depictions of FIGS. 1 and 2, in order to better show the interior of connector 10 and the movable terminal module of the invention. The reason for these drawing orientations is because FIGS. 1 and 2 show second connector 12 mounted on top of printed circuit board 14 which is the typical orientation of the overall assembly, notwithstanding the fact that the connectors herein are omni-directional in use and function. However, in order to better show the interior construction of connector 10, the depictions of FIGS. 3–5 have been inverted from the positions of FIGS. 1 and 2. For instance, upper housing part 26 in the normal orientation of FIGS. 1 and 2 becomes the bottom housing part as viewed in FIGS. 3-5.

In addition, it further should be understood that the use of such words as "upper", "lower", "top", "bottom" and the like herein and in the claims hereof are used to better describe the invention in terms of the drawings and are not intended in any way to be limiting in scope or structure.

With those understandings, lower housing part 28 as viewed in FIGS. 1 and 2 is a sort of cup-shaped structure within which upper housing part 26 and terminal module 16 are mounted. Specifically, the lower housing part has a generally flat bottom wall 28*a*, and a U-shaped side wall 28*b* circumscribing the bottom wall and leaving a front opening 28*c* into and out of which terminal module 16 is reciprocal.

Upper housing part 26 as viewed in FIGS. 1 and 2 includes a generally U-shaped flat top wall 26*a* which becomes the bottom wall as viewed in FIGS. 3–5. A pair of side wall structure 26*b* extend along and project from flat wall 26*a* and define a front opening 30 within which terminal module 16 is reciprocally movable. Each side wall structure 26*b* has an interior spring compartment 32 for housing a coil spring 34 for purposes to be described hereinafter. Side wall structures 26*b* define a pair of inwardly opening receptacle areas 36 immediately inside opposite ends of opening 30. A pair of guide posts 38 project forwardly of a front face 26*c* of housing part 26, again at opposite ends of opening 30. A latch groove 40 is formed in the outside face of each guide post 38 as seen in FIG. 3. The groove extends through front face 26*c* and entirely through the respective interior spring compartment 32 at the respective side of the housing part. Lastly, a locating slot 42 is formed in flat wall 26*a* near the front thereof at opening 30.

The housing parts 26 and 28 are assembled as shown in FIGS. 1 and 2, whereby upper housing part 26 nests within lower housing part 28. Front face 26*c* of the upper housing part closes front opening 28*c* of the lower housing part, and terminal module 16 is reciprocally mounted within opening 3 in the upper housing part, as will be described hereinafter.

Still referring to FIG. 3 in conjunction with FIGS. 1 and 2, a pair of latch arms 44 are mounted within latch grooves 40 which run along the outsides of guide posts 38 and completely through interior spring compartments 32. The latch arms have widened proximal ends 44*a* which are rigidly fixed to housing part 26 within the rear extremities of latch grooves 40. The front or distal ends of the latch arms have outwardly directed latch hooks 44*b* which project outwardly of guide posts 38 as seen in FIG. 1. The distal ends of latch arms 44, along with latch hooks 44*b*, are flexibly movable in the direction of double-headed arrows "B" within latch grooves 40 at the outsides of guide posts 38. Therefore, when second connector 12 is mated with connector 10 as shown in FIG. 2, latch hooks 44*b* snap into latch holes 46 in opposite ends of metal shell 22.

Terminal module 16 includes a dielectric module body, generally designated 50, which is a one-piece structure unitarily molded of dielectric material such as plastic or the like. The body has a front mating end 50*a* and a rear mounting end 50*b*. The body mounts a plurality of conductive terminals, generally designated 52. Module body 50 is elongated in a direction transverse to mating direction "A" (FIG. 1). The body has a pair of mounting wings 54 at opposite ends thereof and which are positioned within inwardly opening receptacle areas 36 (FIG. 3) of housing part 26. When the two housing parts are assembled, wall 28*a* of housing part 28 covers receptacle areas 36 of housing part 26 and completely mounts module body 50 sandwiched between the two housing parts.

Terminals 52 are mounted in a plurality of open grooves 56 in the top and bottom sides of module body 50. The rear end of each open groove 56 has a plurality of recesses 56*a* at opposite sides thereof. The grooves are generally parallel to each other and are spaced lengthwise of module body 50, but the grooves are staggered or alternate in longitudinal location from one side of the body to the other side of the body longitudinally thereof. A plurality of holes 56*b* are formed in front mating end 50*a* of the module body between grooves 56.

Each terminal 52 has a base 52*a*, with a plurality of teeth 52*b* projecting outwardly from opposite edges of the base. The terminals are stamped and formed of conductive sheet metal material. A flexible spring arm 52*c* projects forwardly of base 52*a* and is cantilevered within a respective one of the open grooves 56 in module body 50. A front flexible contact end 52*b* has a convex configuration and presents a rounded contact surface for abutting engagement by an appropriate contact of second connector 12. The convex front flexible contact end 52*d* is bent back inwardly to a hooked distal end 52*e* of the terminal. Finally, a termination arm 52*f* projects rearwardly of base 52*a* and has a termination portion 52*g* at the extreme rear end of each terminal.

In assembly of terminal module 16, terminals 52 are assembled within open grooves 56 of module body 50 by positioning flexible spring arms 52*c* in the open grooves, and teeth 52*b* at opposite edges of base 52*a* are press-fit into recesses 56*a* of module body 50. This rigidly fixes the terminals to the body, leaving flexible spring arms 52*c* free to flex within the grooves, with front convex contact ends 52*d* projecting from front mating end 50*a* of the module body and free to flex thereat. Hooked distal ends 52*e* of the terminals are inserted into holes 56*b* in front mating end 50*a* of the module body. Termination arms 52*f* of the terminals project rearwardly at the rear of the module body, and conductor termination portions 56*g* are terminated to appropriate conductors.

In operation, and referring to FIGS. 4 and 5, terminal module 16 is shown in its extended or projecting position in FIG. 4. This corresponds to the position of the module in the unmated condition of the connectors in FIG. 1. FIG. 5 shows the terminal module in its retracted position and corresponds to the position of the module in FIG. 2 when connectors 10 and 12 are mated. Coil springs 34 within interior spring compartments 32 of housing part 26 are sandwiched between the housing part and mounting wings 54 of module body 50. The springs bias terminal module 16 forwardly in the direction of arrow "C" (FIG. 4) toward its extended or projecting position. When connector 10 is mated with second connector 12, the terminals or contacts of the second connector engage the flexible, convex contact ends 52*d* of terminals 52 and push terminal module 16 rearwardly in the direction of "D" (FIGS. 4 and 5) to the retracted position of the terminal module. It can be seen that mounting wings 54 of the module body 50 move within interior receptacle areas 36 of side wall structures 26*b* of housing part 26. During mating, not only does the entire terminal module 16 move from its extended position to its retracted position, but the flexible convex contact ends 52*d* of the terminals flex along with the flexible characteristics of spring arms 52*c* of the terminals cantilevered within open grooves 56 of module body 50 to ensure that an adequate normal force is created between the mating terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly for mating with a complementary second connector in a mating direction, comprising:

a housing;

a terminal module mounted on the housing for movement relative thereto between a projecting position and a retracted position and including, a dielectrical module body having a front mating end which projects from said housing and a rear mounting end which mounts the terminal module in the housing for movement between said positions, and a plurality of conductive terminals mounted on the module body and including front flexible contact ends projecting from the front mating end of the module body for engaging appropriate terminal contacts of said complementary second connector and rear terminating ends secured to the module body, whereby when the second connector is mated with the connector assembly the contacts of the second connector engage the front flexible contact ends of the terminals and move the terminal module from its projecting position to its retracted position.

2. The electrical connector assembly of claim 1 wherein said dielectric module body includes a plurality of open grooves within which said terminals are disposed.

3. The electrical connector assembly of claim 1 wherein each of said conductive terminals includes a base fixed in the dielectric module body and the front flexible contact end of the terminal is forwardly of the base.

4. The electrical connector assembly of claim 3 wherein said rear terminating end of each terminal comprises a termination arm projecting rearwardly of the base and having a conductor termination portion at the distal end thereof.

5. The electrical connector assembly of claim 3 wherein said front flexible contact end of each terminal is joined to the base by a flexible spring arm cantilevered forwardly of the base.

6. The electrical connector assembly of claim 5 wherein said front flexible contact end of each terminal has a convex configuration and presents a rounded contact surface for abutting engagement by the contacts of the second connector.

7. The electrical connector assembly of claim 1, including biasing means for biasing the terminal module toward its projecting position.

8. The electrical connector assembly of claim 7 wherein said biasing means comprises a coil spring sandwiched between the module body and a portion of the housing.

9. The electrical connector assembly of claim 8 wherein said housing has an interior compartment within which the coil spring is disposed.

10. The electrical connector assembly of claim 7 wherein said module body is elongated in a direction generally transverse to said mating direction to define opposite ends of the body, and including a pair of biasing springs sandwiched between the opposite ends of the body and portions of the housing.

11. The electrical connector assembly of claim 10 wherein said housing has a pair of interior compartments near said opposite ends of the module body within which the biasing springs are located.

12. An electrical connector assembly for mating with a complementary second connector in a mating direction, comprising:

a housing;

a terminal module mounted on the housing for movement relative thereto between a projecting position and a retracted position and including, a dielectrical module body having a front mating end which projects from said housing and a rear mounting end which mounts the terminal module in the housing for movement between said positions, and a plurality of conductive terminals mounted on the module body, each terminal including a base rigidly fixing the terminal in the dielectric module body, a flexible spring arm cantilevered forwardly of the base, and a front flexible contact end of the terminal joined to a front end of the flexible spring arm and projecting from the front mating end of the module body for engaging appropriate terminal contacts of said complementary second connector; and spring means for biasing the terminal module toward its projecting position, whereby when the second connector is mated with the connector assembly the contacts of the second connector engage the front flexible contact ends of the terminals and move the terminal module from its projecting position to its retracted position.

13. The electrical connector assembly of claim 12 wherein said spring means comprises a coil spring located within an interior compartment of the housing and sandwiched between a portion of the housing and the module body.

14. The electrical connector assembly of claim 12 wherein said dielectric module body includes a plurality of open grooves within which said terminals are disposed.

15. The electrical connector assembly of claim 12 wherein said front flexible contact end of each terminal has a convex configuration and presents a rounded contact surface for abutting engagement by the contacts of the second connector.

16. The electrical connector assembly of claim 15, wherein said rear terminating end of each terminal comprises a termination arm projecting rearwardly of the base and having a conductor termination portion at the distal end thereof.

17. The electrical connector assembly of claim 12 wherein said module body is elongated in a direction generally transverse to said mating direction to define opposite ends of the body, and including a pair of biasing springs sandwiched between the opposite ends of the body and portions of the housing.

18. The electrical connector assembly of claim 17 wherein said housing has a pair of interior compartments near said opposite ends of the module body within which the biasing springs are located.

* * * * *